US011986879B2

(12) United States Patent
Wang et al.

(10) Patent No.: US 11,986,879 B2
(45) Date of Patent: May 21, 2024

(54) METHOD TO INCREASE LOCAL COOLING RATE AND IMPROVE MATERIAL PROPERTIES IN A LOW-PRESSURE SAND-CASTING HEAD

(71) Applicant: GM Global Technology Operations LLC, Detroit, MI (US)

(72) Inventors: Liang Wang, Rochester Hills, MI (US); Qigui Wang, Rochester Hills, MI (US); Dale A. Gerard, Bloomfield Hills, MI (US); Steven L. Burkholder, Archbold, OH (US); Ronald C. Daul, Northville, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 7 days.

(21) Appl. No.: 17/719,737

(22) Filed: Apr. 13, 2022

(65) Prior Publication Data

US 2023/0330744 A1 Oct. 19, 2023

(51) Int. Cl.

| | |
|---|---|
| ***B22C 3/00*** | (2006.01) |
| ***B22C 9/02*** | (2006.01) |
| ***B22C 9/06*** | (2006.01) |
| ***B22C 9/10*** | (2006.01) |
| ***B22D 15/02*** | (2006.01) |

(52) U.S. Cl.
CPC ..... *B22D 15/02* (2013.01); *B22C 3/00* (2013.01); *B22C 9/02* (2013.01); *B22C 9/061* (2013.01); *B22C 9/101* (2013.01)

(58) Field of Classification Search
CPC ..... B22C 3/00; B22D 29/001
See application file for complete search history.

(56) References Cited

U.S. PATENT DOCUMENTS

| | | | | |
|---|---|---|---|---|
| 1,466,738 A * | 9/1923 | Morse | B22D 7/04 164/72 |
| 4,032,105 A * | 6/1977 | Gritzner | B22C 9/103 249/134 |
| 5,611,388 A * | 3/1997 | Fukuoka | B22D 18/04 164/137 |
| 2017/0087631 A1* | 3/2017 | Gold | B22C 9/02 |
| 2022/0097125 A1* | 3/2022 | Choudhary | B22C 9/10 |

FOREIGN PATENT DOCUMENTS

| | | | |
|---|---|---|---|
| GB | 1338865 A * | 11/1973 | B22C 3/00 |

* cited by examiner

*Primary Examiner* — Kevin P Kerns
*Assistant Examiner* — Jacky Yuen
(74) *Attorney, Agent, or Firm* — Vivacqua Crane, PLLC

(57) ABSTRACT

A low-pressure sand-casting system includes a sand-casting mold receiving a molten casting material to cast an automobile vehicle cylinder head. A port is created in the automobile vehicle cylinder head. A manifold port metal core assembly includes a metal core. A compressible material coating is applied on the manifold port core metal core.

8 Claims, 4 Drawing Sheets

METHOD TO INCREASE LOCAL COOLING RATE AND IMPROVE MATERIAL PROPERTIES IN A LOW-PRESSURE SAND-CASTING HEAD

GOVERNMENT LICENSE RIGHTS

This invention was made with government support under United States Department of Energy (USDOE) contract: DE-EE0008877 awarded by the United States Department of Energy. The government has certain rights to the invention.

INTRODUCTION

The present disclosure relates generally to casting of automobile vehicle engine cylinder heads.

A semi-permanent mold (SPM) process has been used to produce cast automobile vehicle engine cylinder heads, however the SPM process requires preparation of molds which are expensive to produce. The SPM process may also result is turbulence during a mold filling operation which is detrimental to finished cast material properties. In order to reduce turbulence during a mold filling operation, a low-pressure sand-casting (LPSC) process has been used for automobile vehicle engine cylinder head casting. The known LPSC process however has to date not been able to achieve the same material properties as those achieved using the Semi-Permanent Mold (SPM) process.

Thus, while current automobile vehicle engine cylinder head casting methods achieve their intended purpose, there is a need for a new and improved system and method for casting automobile vehicle engine cylinder heads.

SUMMARY

According to several aspects, a low-pressure sand-casting system includes a sand-casting mold receiving a molten casting material to cast an automobile vehicle cylinder head. A port is created in the automobile vehicle cylinder head. A manifold port metal core assembly includes a metal core. A compressible material coating is applied on the manifold port core metal core.

In another aspect of the present disclosure, an initial thickness (t) of the compressible material coating is predetermined based on a calculated value of port shrinkage occurring at the port during cooling of the cast cylinder head.

In another aspect of the present disclosure, the initial thickness of the compressible material coating is defined by $t \geq CTE \times (Tsolidus - Tshakeout) \times \frac{1}{2} Deq$.

In another aspect of the present disclosure, the manifold port metal core assembly includes a graphite and carbon fiber coating having a through-shell sand core.

In another aspect of the present disclosure, the through-shell sand core includes a zircon material having multiple through-thickness passages defining holes or open channels, the through-thickness passages collapsing upon application of a pressure as the casting material at the port cools and shrinks.

In another aspect of the present disclosure, the graphite and carbon fiber coating includes an inner layer located proximate to an outer surface of a first end of the manifold port metal core and an outer layer forming an outer surface, the inner layer and the outer layer enclosing the through-shell sand core.

In another aspect of the present disclosure, the compressible material coating is positioned at an opening of the port between the metal core and an inner wall of the port and thereby compresses during cooling of the cast cylinder head to a compressed condition which precludes direct metal-to-metal contact between the inner wall of the port and the metal core.

In another aspect of the present disclosure, the compressible material coating is applied onto the metal core by spray coating, printing or dipping at least proximate to an end face of the metal core at a first end of the metal core.

In another aspect of the present disclosure, the compressible material coating includes a porous graphite and a carbon fiber.

In another aspect of the present disclosure, a body of the metal core has a tapering shape continuously reducing in cross sectional area from a first end having a first cross sectional area toward a second end having a second cross sectional area smaller than the first cross sectional area.

According to several aspects, a method to locally increase cooling during casting of an automobile vehicle cylinder head comprises: creating a port in an automobile engine cast cylinder head low pressure sand-casting mold; applying a compressible material coating having graphite and carbon fiber on a metal core of a manifold port metal core assembly; predetermining an initial thickness (t) of the compressible material coating at least equal to a compression amount of the compressible material coating anticipated due to shrinkage of a casting material proximate to the port and surrounding the compressible material coating as the casting material cools; and inserting the manifold port metal core assembly into the port prior to filling the cylinder head sand-casting mold with the casting material.

In another aspect of the present disclosure, the method further includes adding a through-shell sand core into the compressible material coating.

In another aspect of the present disclosure, the method further includes printing the through-sand core having multiple through-thickness passages defining holes or open channels.

In another aspect of the present disclosure, the method further includes selecting the through-shell sand core having a zircon containing material.

In another aspect of the present disclosure, the method further includes calculating the initial thickness (t) of the compressible material coating using an equation wherein $t \geq CTE \times (Tsolidus - Tshakeout) \times \frac{1}{2} Deq$.

In another aspect of the present disclosure, the method further includes adding a metal chill pin in the manifold port metal core assembly prior to inserting the manifold port metal core assembly to locally increase heat transfer during cooling of the casting material at a location of the port.

In another aspect of the present disclosure, the method further includes embedding a chill into the automobile engine cast cylinder head low pressure sand-casting mold and providing a coolant flow to the chill.

According to several aspects, a method to locally increase cooling during casting of an automobile vehicle cylinder head comprises: creating a port in an automobile engine cast cylinder head low pressure sand-casting mold; applying a compressible material coating on a metal core of a manifold port metal core assembly; selecting a material of the compressible material coating exhibiting an increasing thermal conductivity during compression of the compressible material coating; and inserting the manifold port metal core assembly into the port and filling the cylinder head sand-casting mold with a casting material.

In another aspect of the present disclosure, the method further includes predetermining an initial thickness (t) of the compressible material coating at least equal to a compression amount of the compressible material coating anticipated due to shrinkage of the casting material located proximate to the port and surrounding the compressible material coating as the casting material cools.

In another aspect of the present disclosure, the method further includes adding a thermally conductive through-shell sand core into the compressible material coating.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
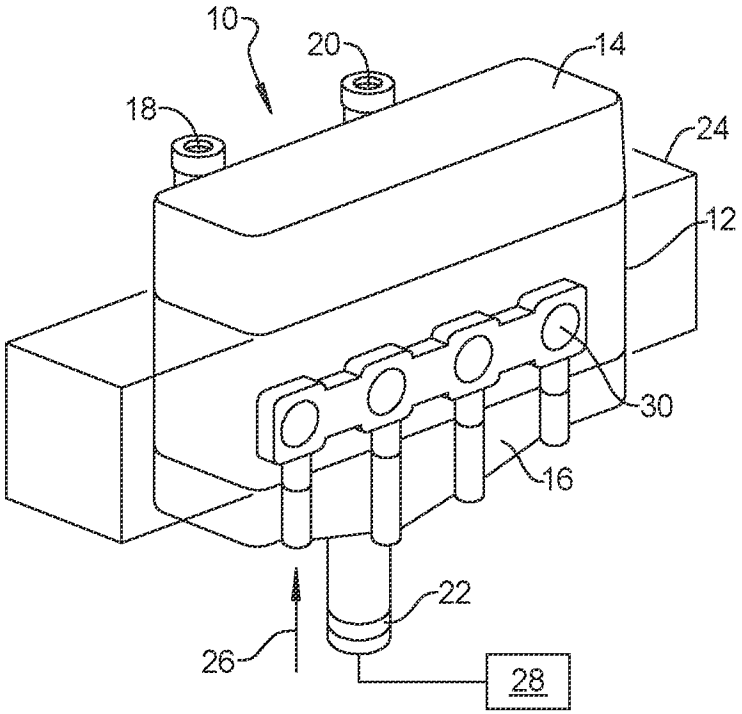
FIG. 1 is a front perspective view of an automobile vehicle engine cylinder head according to an exemplary embodiment.

Referring to FIG. 1, a low-pressure sand-casting head system 10 produces a cast cylinder head 12 using a sand-casting chill 14 and a sprue 16. At least one coolant supply connection 18 and at least one coolant discharge connection 20 provide a coolant flow for the sand-casting chill 14. The coolant may be provided for example as chilled water to the sand-casting chill 14 to cool an upper portion of a sand-casting mold 24, only partially shown in this view for clarity. Molten casting metal such as iron or aluminum is fed under pressure into the sprue 16 via a sprue inlet 22 which then flows upwardly in a flow direction 26 into the sand-casting mold 24 thereby forming the cylinder head 12. A pump 28 provides pressurized flow of the molten metal into the sand-casting mold 24 and may thereby control a flow rate of the molten metal into the sand-casting mold 24.

At least one and according to several aspects multiple ports 30 may be provided with the casting including but not limited to exhaust ports. To obtain the complexity of a port geometry required, individual metal cores are pre-inserted into individual ones of the ports prior to the casting operation. These metal cores are shown and described in greater detail in reference to FIGS. 2 and 3. Following completion of the casting operation and after the cast cylinder head 12 has cooled, the cast cylinder head 12 is removed from the sand-casting mold 24 and the metal cores are removed. A new sand-casting mold 24 is then created and the metal cores are cleaned and inserted into the new sand-casting mold 24 for casting a next cast cylinder head 12.

Referring to FIG. 2 and again to FIG. 1, an exemplary manifold port metal core assembly 32 includes a metal core 34 which may be for example aluminum or steel. As the cast cylinder head 12 cools within the sand-casting mold 24, the ports 30 such as the exhaust ports shown contract or shrink which could thereby trap the metal core 34 and prevent removal of the metal core 34. A value of the port shrinkage may be calculated. To allow for removal of the metal core 34 after casting and to provide the necessary geometry of the ports while accommodating the expected amount of port shrinkage during cooling, the metal core 34 is provided with a compressible material coating 36 covering at least a portion of the metal core. An initial thickness 47 shown and described in reference to FIG. 3 of the compressible material coating 36 is predetermined based on a calculated value of port shrinkage occurring during cooling of the cast cylinder head 12. The compressible material coating 36 is located at an opening of the port between the metal core 34 and the inner wall of the port and thereby compresses during cooling of the cast cylinder head 12 to a compressed condition shown and described in reference to FIG. 3 which precludes direct metal-to-metal contact between opposing walls of the port and the metal core 34. The compressed condition retains a portion of the compressible material coating 36 which is frangible to allow subsequent removal and reuse of the manifold port metal core assembly 32.

According to several aspects, the compressible material coating 36 is applied onto the metal core 34 for example by spray coating, printing or dipping at least proximate to an end face 38 of the metal core 34 at a first end 40 of the metal core 34. A material of the compressible material coating 36 may include a porous graphite and may further include a carbon fiber material. The porous graphite is selected for its connective property to releasably couple to the metal core 34 and for its ability to provide the predetermined amount of compression expected during port shrinkage during mold cooling. The carbon fiber material is added to increase a thermal conductivity of the compressible material coating 36 which thereby enhances localized cooling.

The compressible material coating 36 improves cooling of the molten material proximate to the ports which promotes development of a finer microstructure of the cast material and a reduced porosity of the cast cylinder head 12 material. To assist in subsequent removal of the metal core 34 from the completed and cooled cast cylinder head 12, a body 42 of individual ones of the metal core 34 may have a tapering shape continuously reducing in cross sectional area from the first end 40 having a first cross sectional area toward a second end 44 having a second cross sectional area smaller than the first cross sectional area. An outer surface 46 of the compressible material coating 36 located at the first end 40 provides a desired geometry of the individual port allowing for subsequent shrinkage as the cast material cools.

Figure 2:
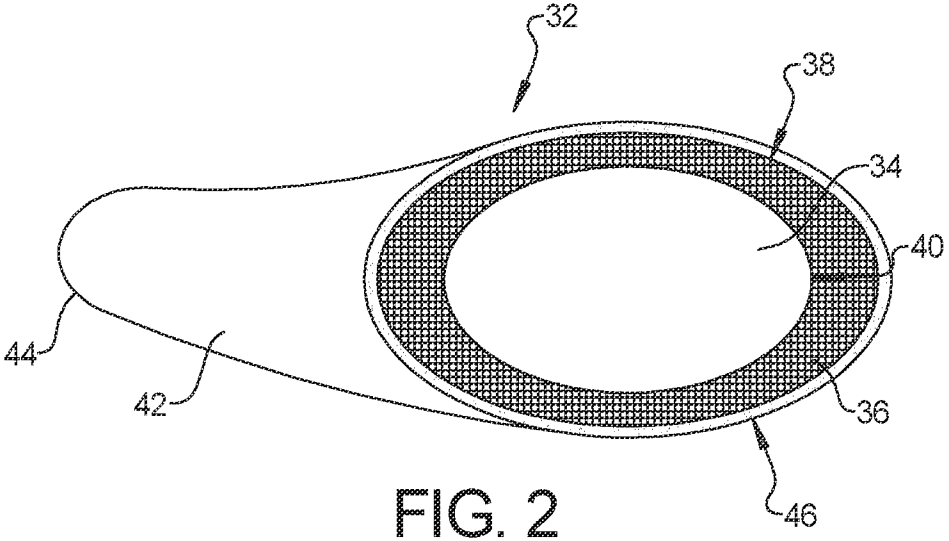
FIG. 2 is a front elevational view of a manifold port metal core assembly used in casting the cylinder head of FIG. 1.

Referring to FIG. 3 and again to FIGS. 1 and 2, an initial thickness 47 of the compressible material coating 36 is determined by calculating an approximate value of shrinkage of the metal casting material as the casting material cools and the multiple ports 30 shrink in area, including but not limited to the exhaust ports shown in FIG. 1. A compressed condition 48 of the compressible material coating 36 occurring after shrinkage of the cast material local to the multiple ports 30 allows for a minimal clearance 49 between the compressible material coating 36 and the metal core 34 to facilitate removal of the manifold port metal core assembly 32. A value of the initial thickness 47 defined as "t" may be determined using Equation 1 below:

Equation 1

$$t \geq CTE \times (Tsolidus - Tshakeout) \times \frac{1}{2} Deq$$

Where:

CTE is a coefficient of thermal expansion of the casting metal material

Figure 4:
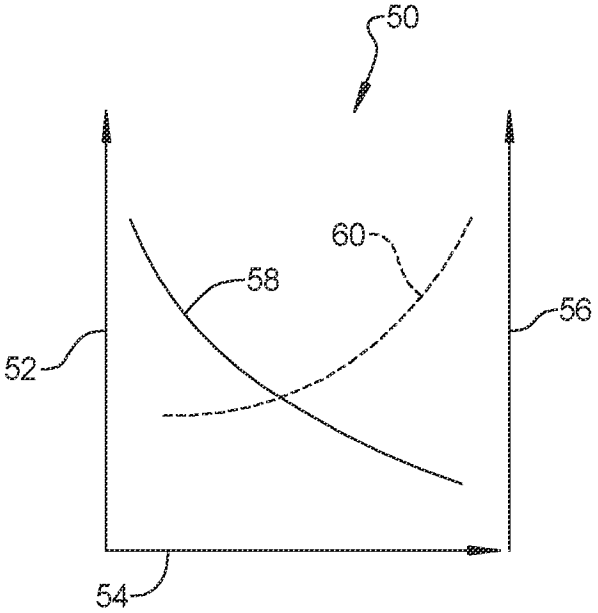
FIG. 4 is a graph presenting core insert coating thickness and thermal conductivity under the influence of pressure during casting cooling.
Figure 3:
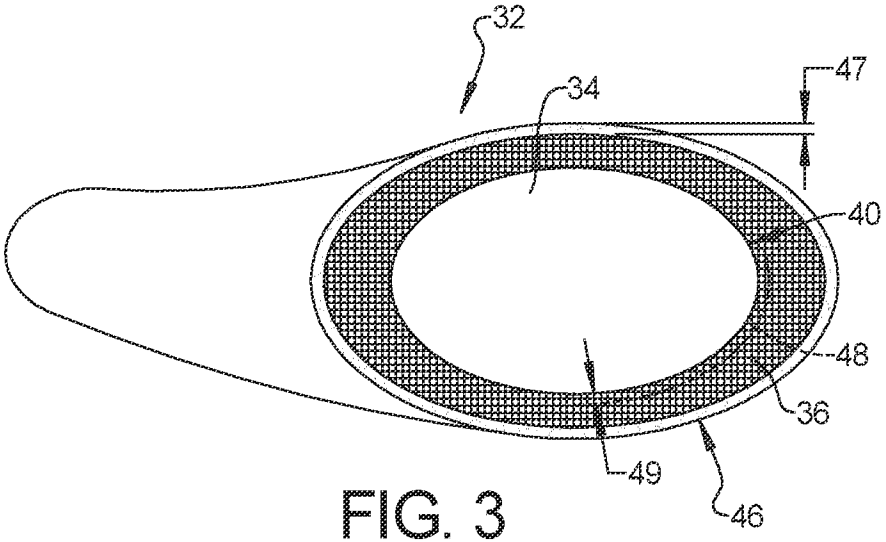
FIG. 3 is a front elevational view of the manifold port metal core assembly of FIG. 2.

Tsolidus is the temperature of the metal when it becomes 100% solid bTshakeout is the temperature of the metal after cooling in the mold Deq is an equivalent diameter of the port Referring to FIG. 4 and again to FIGS. 1 through 3, a graph 50 identifies a coating thickness 52 of compressible material coating 36, a pressure 54 acting on the manifold port metal core assembly 32 resulting during cooling compression and a thermal conductivity 56 of the compressible material coating 36. A first curve 58 identifies a steadily decreasing thickness of the compressible material coating 36 from its original or initial thickness 47 defined above as the pressure 54 due to shrinkage of the casting material increases over time. A second curve 60 identifies a steadily increasing value of a thermal conductivity of the compressible material coating 36 as the compressible material coating 36 compresses. An enhanced cooling rate of the casting material is thereby provided locally at the multiple ports as the compressible material coating 36 compresses.

Figure 5:
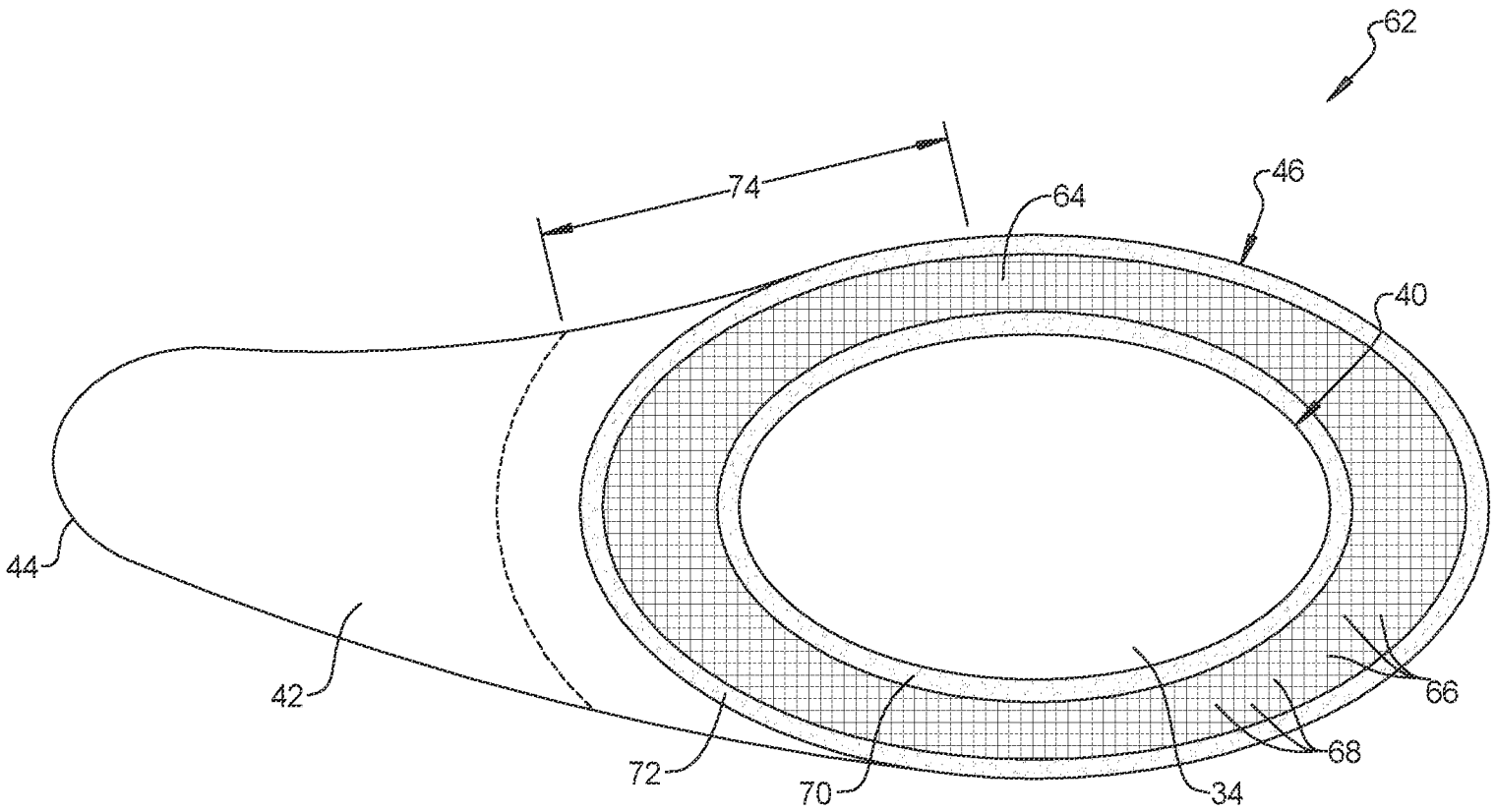
FIG. 5 is a front elevational view of a manifold port metal core assembly modified from FIG. 2.

Referring to FIG. 5 and again to FIGS. 2 and 3, according to another aspect a manifold port metal core assembly 62 is modified from the manifold port metal core assembly 32 as follows, with common components numbered the same as the manifold port metal core assembly 32. The manifold port metal core assembly 62 includes a compressible material coating 64 applied onto the metal core 34 at the first end 40 of the metal core 34. The manifold port metal core assembly 62 includes a graphite/carbon fiber coating described below having a through-shell sand core 66. The through-shell sand core 66 may be additive manufacturing machine printed or have the first end 40 dipped into the graphite/carbon fiber material, and includes multiple through-thickness passages 68 defining holes or open channels. The through-thickness passages 68 collapse upon application of pressure as the mold casting material at the multiple ports cools and shrinks. The graphite/carbon fiber coating may be provided as an inner layer 70 located proximate to an outer surface of the first end 40 and an outer layer 72 forming the outer surface 46. The inner layer 70 and the outer layer 72 enclose the through-shell sand core 66.

According to several aspects, the through-shell sand core 66 may be provided of a zircon material which may include zirconium, zirconine, and Zircodyne® as well as other alloys of zirconium. Different alloys of zircon may be used in different areas or layers of the through-shell sand core 66 to modify a heat transfer rate or to locally increase a heat transfer rate as desired. Heat that is transferred from the material of the cast cylinder head 12 as it cools to the manifold port metal core assembly 62 passes rapidly through the inner layer 70 and the outer layer 72 at an increasing rate as the through-thickness passages 68 of the through-shell sand core 66 collapse.

According to several aspects, the compressible material coating 64 may extend away from the first end 40 toward the second end 44. This extension may be for a partial length 74 of the metal core 34 to provide enhanced cooling and dimensional control of the multiple ports during casting.

Referring to FIG. 6 and again to FIGS. 1 through 5, an assembly 76 provides multiple sand cores 78 provided with metal connecting arms 80. The assembly 76 may be inserted into the sand-casting mold 24 to produce the cast cylinder head 12 and withdrawn as a unit following the casting operation completion. By preassembling the multiple sand cores 78 before insertion into the sand-casting mold 24 the assembly 76 provides for consistent dimensional control of the ports 30.

Figure 7:
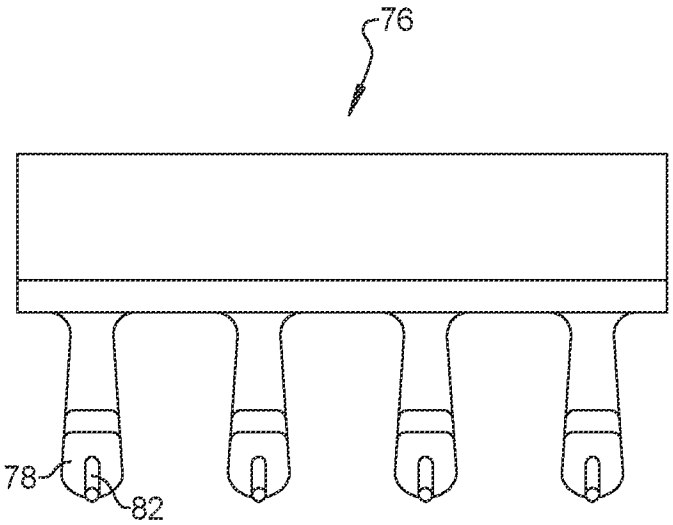
FIG. 7 is a front elevational view of the assembly of manifold port cores of FIG. 6 modified to include chill pins.
Figure 6:
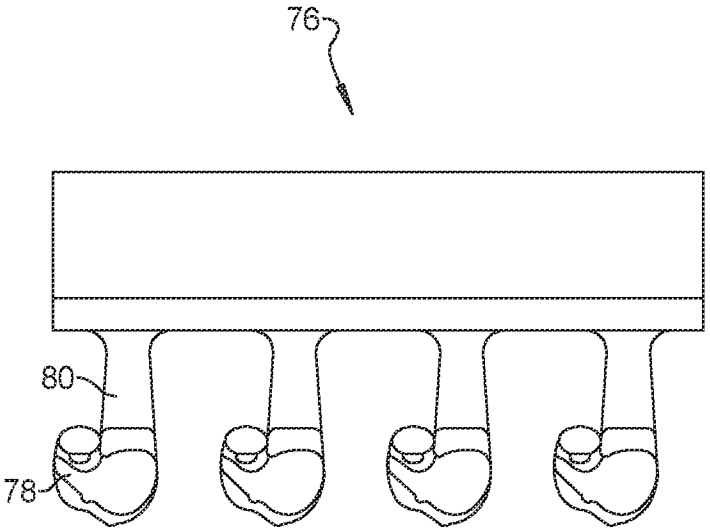
FIG. 6 is a front elevational view of an assembly of manifold port cores of the present disclosure.

Referring to FIG. 7 and again to FIG. 6, the assembly 76 may be modified to further improve a cooling rate at the locations of the ports 30. A chill pin 82 made of a thermally conductive metal is inserted into individual ones of the multiple sand cores 78 at the time of assembly of the sand cores 78. The chill pin 82 locally increases heat transfer during cooling of the molten metal at the locations of the ports 30.

A low-pressure sand-casting system of the present disclosure provides increased local cooling in the exhaust manifold ports of a cylinder head made by a low-pressure sand-casting method. The exhaust manifold ports may be made by hybrid cores with shell sand using a center metal chill. The hybrid core prints are set on a metal chill which forms the manifold port opening. The low-pressure sand-casting system reduces core print contact areas with the casting by the addition of a core print support pin. A side chill is embedded in the sand mold. A high thermal conductivity and heat sink coating is added to the port core surface. A high thermal conductivity and heat sink sand may also be used to make the core or shell core. A porous graphene/graphite/carbon fiber thermal-conductive coating is applied having a coating density and a thermal conductivity increasing with pressure, for example during manifold port aluminum shrinkage. An initial coating thickness is predetermined to enhance final manifold port metal core extraction. A porous shell sand core may also be provided having a graphene/graphite/carbon fiber thermal-conductive coating on surfaces and interior passages. Heat is thereby transferred from a head casting to a manifold port metal core quickly through the graphene/graphite/carbon fiber surface coatings and a network in the shell sand core.

A low-pressure sand-casting system and a method of performing low pressure sand casting of the present disclosure offers several advantages. These include the application of specially designed hybrid core, coating, and core prints particularly in an exhaust side of the cylinder heads to attain similar and better properties as achieved in the Semi-Permanent Mold (SPM) process. The casting technique of the present disclosure provides improved cooling during solidification, resulting in finer cast material microstructure having a lower porosity than parts cast using previously applied SPM methods. This results in higher mechanical properties at hot spot locations as well as meeting safety factor design criteria.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A method for low-pressure sand-casting a cylinder head of an automobile vehicle engine, comprising:

creating a port in an automobile engine cast cylinder head low pressure sand-casting mold;

applying a compressible material coating having graphite and carbon fiber on a metal core of a manifold port metal core assembly, wherein the compressible material coating includes an inner layer disposed on a first end of the metal core, a through-shell sand core disposed on the inner layer and having multiple through-thickness passages defining holes or open channels, and an outer layer disposed on the through-shell sand core;

predetermining an initial thickness (t) of the compressible material coating at least equal to a compression amount of the compressible material coating anticipated due to shrinkage of a casting material located proximate to the port and surrounding the compressible material coating as the casting material cools; and inserting the manifold port metal core assembly into the port prior to filling the cylinder head sand-casting mold with the casting material.

2. The method of claim 1, further including printing the through shell sand core having multiple through-thickness passages defining holes or open channels.

3. The method of claim 1, further including selecting the through-shell sand core having a zircon containing material.

4. The method of claim 1, further including calculating the initial thickness (t) of the compressible material coating applying an equation wherein $t \geq CTE \times (Tsolidus - Tshake\text{-}out) \times \frac{1}{2} Deq$.

5. The method of claim 1, further including adding a metal chill pin in the manifold port metal core assembly prior to inserting the manifold port metal core assembly to locally increase heat transfer during cooling of the casting material at a location of the port.

6. The method of claim 1, further including embedding a chill into the automobile engine cast cylinder head low pressure sand-casting mold and providing a coolant flow to the chill.

7. The method of claim 1, wherein the compressible material coating is applied onto the metal core by spray coating, printing or dipping at least proximate to an end face of the metal core at a first end of the metal core.

8. The method of claim 1, wherein a body of the metal core has a tapering shape continuously reducing in cross sectional area from the first end having a first cross sectional area toward a second end having a second cross sectional area smaller than the first cross sectional area.

* * * * *